United States Patent [19]

Grow et al.

[11] 4,442,691

[45] Apr. 17, 1984

[54] DOUBLE ACTION PRESS HAVING FLOATING PUNCH

[75] Inventors: Arthur L. Grow, Versailles; Charles J. Gregorovich, St. Marys; Donald N. Seyfried, New Bremen, all of Ohio

[73] Assignee: The Minster Machine Company, Minster, Ohio

[21] Appl. No.: 468,490

[22] Filed: Feb. 22, 1983

Related U.S. Application Data

[63] Continuation of Ser. No. 165,966, Jul. 7, 1980, abandoned.

[51] Int. Cl.[3] ..... B21D 28/02; B21D 28/20

[52] U.S. Cl. ..... 72/329; 72/456; 72/465; 413/56

[58] Field of Search ..... 72/329, 328, 330, 339, 72/336, 335, 347∝351, 456, 465; 413/56

[56] References Cited

U.S. PATENT DOCUMENTS

| | | | |
|---|---|---|---|
| 413,667 | 10/1889 | Hodgson | 72/336 |
| 864,417 | 8/1907 | Freier | 72/336 |
| 1,995,357 | 3/1935 | Liss | 72/328 |
| 2,411,503 | 11/1946 | Calleson et al. . | |
| 2,767,674 | 10/1956 | Ott | 72/315 |
| 3,312,098 | 4/1967 | Hendrickson | 72/349 |
| 3,405,546 | 10/1968 | Hoffman et al. | 72/348 |
| 3,768,295 | 10/1973 | Cudzik | 413/56 |
| 3,861,192 | 1/1975 | Suzuki et al. | 72/456 |
| 3,902,347 | 9/1975 | Ridgeway et al. | 72/336 |
| 3,948,075 | 4/1976 | Finsterwalder et al. | 72/351 |
| 3,986,382 | 10/1976 | Miller et al. | 72/347 |
| 4,100,788 | 7/1978 | Morini | 72/329 |

FOREIGN PATENT DOCUMENTS

| | | | |
|---|---|---|---|
| 613455 | 1/1961 | Canada | 72/456 |
| 52833 | 3/1937 | Denmark | 72/329 |
| 166424 | 12/1905 | Fed. Rep. of Germany | 72/350 |
| 1193466 | 6/1970 | United Kingdom | 72/456 |
| 1256044 | 12/1971 | United Kingdom . | |
| 1400959 | 7/1975 | United Kingdom . | |
| 209396 | 1/1968 | U.S.S.R. | 72/456 |

OTHER PUBLICATIONS

Apex Tool Works Catalog "Engineered Tooling for Container Manufacturers" and Two-Out Can End Press.

*Primary Examiner*—Daniel C. Crane
*Attorney, Agent, or Firm*—Albert L. Jeffers; John F. Hoffman

[57] ABSTRACT

A double action mechanical press, especially for performing a blanking operation and a forming operation on each cycle thereof, having a first slide and a second slide, wherein the slides have separate strokes. The slides are reciprocated by means of a crankshaft and connecting rod assembly comprising a single crankshaft and a plurality of connecting rods wherein the throws of the crankshaft can be differently dimensioned and angularly offset relative to each other so as to provide different stroke lengths for the slides and to cause one slide to lead the other. A guide bushing assembly is connected to one of the press slides, and a blanking punch is received in the guide bushing for reciprocating movement relative to the bushing along the same direction of reciprocating movement as the slides. A preloaded antifriction bearing is positioned between the punch and bushing assembly, and serves to maintain the proper clearance between the punch and the corresponding cutting edge on the lower die half. A forming die is received in the guide bushing assembly for reciprocating movement relative thereto and is connected to the other press slide. The other portion of the punch is formed as a piston and is urged downwardly by pressurized air. The travel of the punch against the pressurized air enables the punch to abut the top of the strip material until the blanking slide strikes it and causes it to blank out the part. Meanwhile, the forming die draws the blanked out part, which is continued to be held by the pressure of the punch against the liftout ring. Thus, the action of the floating punch simulates the dwell provided by a cam driven punch.

17 Claims, 7 Drawing Figures

DOUBLE ACTION PRESS HAVING FLOATING PUNCH

This is a continuation of application Ser. No. 165,966 filed July 7, 1980, now abandoned.

BACKGROUND OF THE INVENTION

The present invention relates to mechanical presses, and in particular to double action presses wherein a blanking and forming operation is performed on each cycle of the press.

In making can ends, for example, one slide of the press performs the blanking operation, which punches out a circular blank from strip stock, and the other slide forms the circular blank into a can end by means of a drawing operation. Thus, both operations can be performed on a single cycle of the press.

Due to the fact that the blanking operation must be carried out prior to the drawing operation, presses of this type are constructed such that the blanking slide will lead the forming slide. Furthermore, it is necessary to hold the blanked part during at least a portion of the drawing operation so as to prevent wrinkling. Some prior art presses have accomplished this by permitting the blanking punch to travel through the tin line and continue to exert pressure on the blanked part during the drawing operation. By permitting the blanking punch to overtravel past the cutting edge, excessive wear of the cutting edge is caused by the punch sliding past it. Unless proper clearance between the punch and cutting edge can be maintained at all times, metal to metal contact between the punch and cutting edge will occur during the overtravel portion of the cycle. A further disadvantage to overtravel of the blanking punch is that the punch will necessarily have a longer residence time beneath the tin line than will the forming die, and this delays ejection of the finished part.

In order to avoid overtravel of the blanking punch, certain types of presses drive the blanking punch slide by means of a cam. The cam is manufactured so that the blanking punch is caused to dwell at the bottom of its stroke at a point just below the tin line. This maintains pressure on the blanked part yet avoids overtravel so that the blanking punch can begin its return stroke at the same time as or just before the return stroke of the forming die. In a cam driven press of this type, the mechanism is quite complicated. Moreover, the fact that the contact between the cam and connecting rod is only a line contact, lubrication is difficult and the cam surfaces are subject to wear.

SUMMARY OF THE INVENTION

In order to overcome the above problems and disadvantages of prior art double action presses utilized for a blanking and forming operation, the press according to the present invention drives the two slides by means of a crankshaft and connecting rod assembly, yet simulates the dwell achieved by prior art cam driven presses. The blanking and drawing slides are driven by means of a crankshaft and connecting rod assembly such as that disclosed in U.S. Pat. No. 3,902,347, which is owned by the assignee of the present application, and which is expressly incorporated herein by reference. It has been found that this type of press drive results in a relatively simple, but extremely rigid structure. Since the connecting rods surround the crankshaft throws, a much larger oil film results, thereby reducing wear between these parts.

The dwell produced by prior art cam drives is simulated by permitting the blanking punch to float within the guide bushing structure connected to the blanking slide. The punch is received within the bushing assembly for reciprocating movement relative to the blanking slide along the same rectilinear direction of movement as the slide. The upper portion of the blanking punch is formed as a piston and reciprocates within a cylinder formed in the bushing assembly. Pressurized air is admitted to the cylinder and continuously urges the punch downwardly. On the downstroke of the blanking slide, the punch initially contacts the strip of material, but does not cut through the material until the blanking slide catches up with it and drives the punch through the material to cut the blank. The pressurized air maintains the punch in clamping engagement with the blanked part during at least a portion of the drawing operation, and the blanking slide will lift the punch at the same time as the forming die is lifted by its slide. Since the blanking punch and forming die are lifted together, the part can be ejected much more quickly than if the punch overtraveled as in the case of certain prior art presses.

A further advantage to maintaining contact between the blanking punch and part is that it facilitates stripping the part from the lower die. The closer the punch is to the drawing die when the part is stripped, the more control can be maintained on the part during the stripping and ejecting sequence.

A significant problem with floating punches per se is that of maintaining alignment and proper clearance relative to the cutting edge, especially with thin stock. If proper clearance is not maintained, the punch may contact the cutting edge during the blanking stroke, thereby chipping the cutting edge. The punch assembly according to the present invention overcomes this problem by providing preloaded antifriction bearings between the punch and the guide bushing, which very accurately guide and align and punch as it reciprocates within the guide bushing assembly and as it is reciprocated by the blanking slide itself.

Specifically, the present invention contemplates a double action press comprising a first slide member, a second slide member and a driven crankshaft and connecting rod assembly connected to the slide members for reciprocating them along respective rectilinear paths. A pair of cooperating first tool elements are mounted in the press wherein one of the tool elements is connected to the first slide member and is reciprocated by the first slide member relative to the other tool element in the pair, and a pair of second cooperating tool elements are mounted in the press wherein one of the second tool elements is connected to the second slide member and is reciprocated thereby relative to the other of the second tool elements. The one second tool element is connected to the second slide member for reciprocating movement relative thereto along the same rectilinear direction as the movement of the second slide member, the total rectilinear travel of the second tool element relative to the second slide member being less than the total rectilinear travel of the second slide member itself. Means are provided on the second slide member for a yieldably urging the second tool element connected thereto toward the other second tool element making up the pair and in a direction generally away from the second slide member.

The invention also contemplates a blanking and forming punch assembly adapted for use in a double action press having two slides reciprocated through separate strokes. The punch assembly comprises a guide housing adapted for connection to one of the press slides, a blanking punch received in the guide housing for reciprocating movement relative to the housing along a given rectilinear direction, and a preloaded antifriction bearing positioned between the punch and housing and in antifriction contact with at least one of the punch and housing to accurately guide and align the punch relative to the housing. Means are interposed between the punch and housing for yieldably urging the punch in a direction out of the housing toward one of the limits of travel of the punch relative to the housing. A forming die adapted for connection to the other press slide is received in the guide housing for reciprocating movement relative to the housing along the rectilinear direction.

It is an object of the present invention to provide a double action press wherein blanking and forming operations can be performed in a single cycle of the press, and wherein overtravel of the blanking punch is avoided.

It is a further object of the present invention to provide a double action press wherein the dwell of a blanking punch is accomplished without resorting to the use of a cam drive. This object is accomplished by utilizing a crankshaft drive for the slides, wherein the blanking punch is permitted to reciprocate relative to the blanking slide against the pressure of a yieldable medium.

These and other objects and features of the present invention will become apparent from the description of the preferred embodiment, taken together with the drawings.

DESCRIPTION OF THE PREFERRED EMBODIMENT

Figure 1:
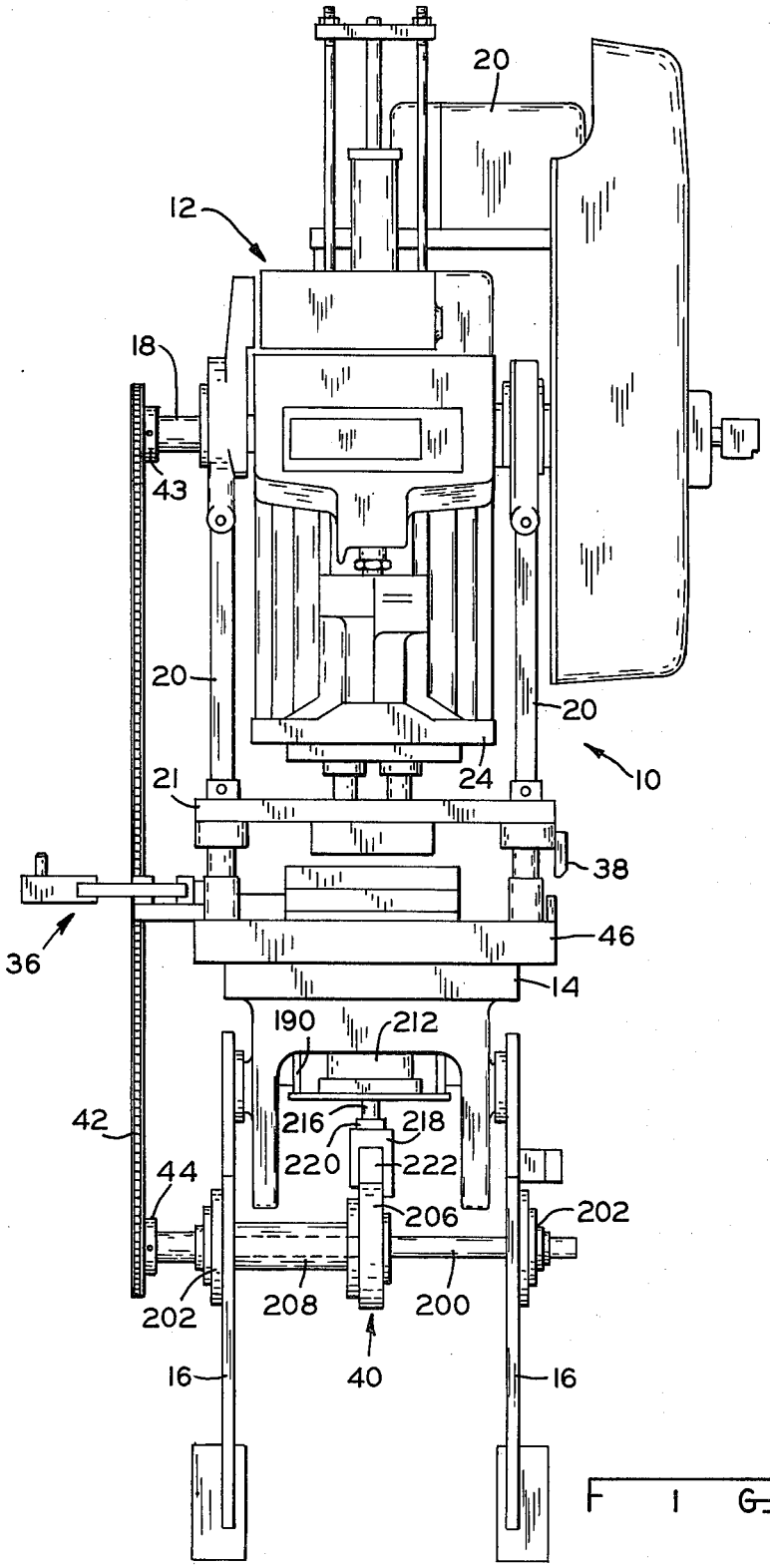
FIG. 1 is a front elevational view of a press incorporating the present invention.
Figure 7:
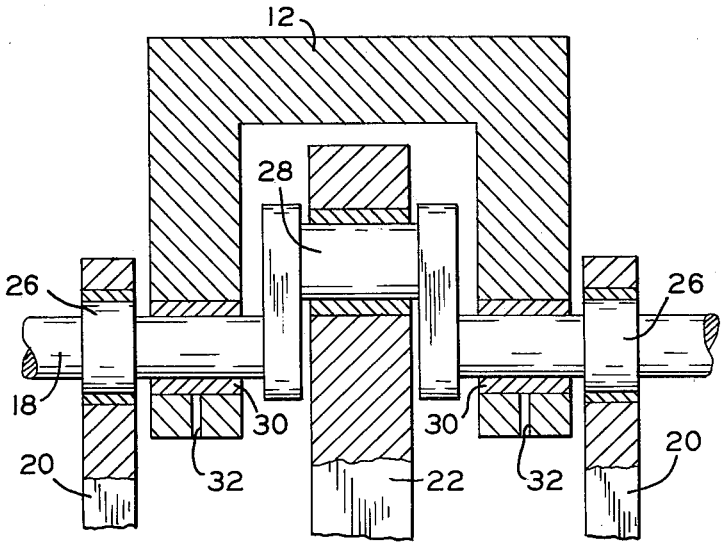
FIG. 7 is a diagrammatic view of the drive mechanism for the slides.
Figure 6:
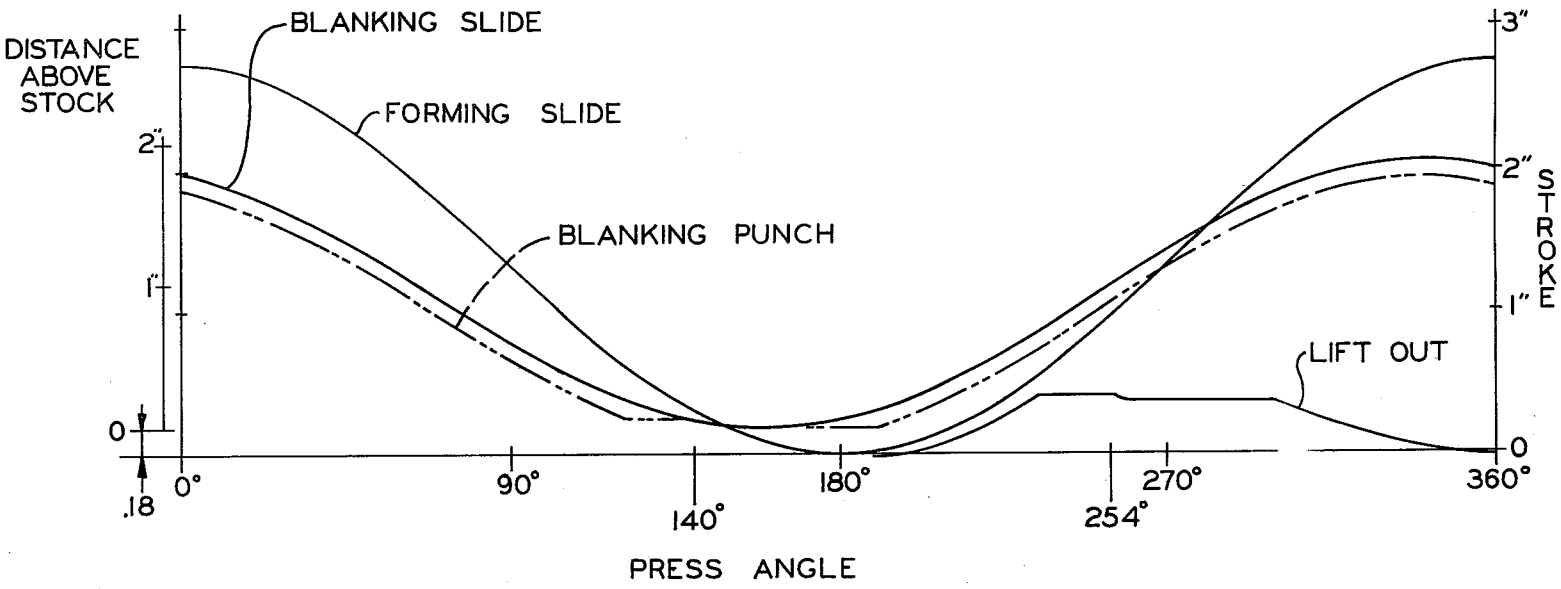
FIG. 6 is a graph plotting the postions of the blanking slide, forming slide and punch above bottom dead center and above the strip stock for a complete press cycle.

Referring now to the drawings in detail, FIG. 1 illustrates a press 10 comprising a crown 12 connected to a bed 14, the latter being supported on legs 16. The press crankshaft 18 is driven by an electric motor 20 connected thereto by a belt and pulley mechanism and a clutch (not shown). FIG. 7 illustrates diagrammatically the connections between crankshaft 18 and connecting rods 20, which are connected to the blanking slide 21 (FIG. 1), and connecting rod 22, which is connected to the forming slide 24 (FIG. 1). Outermost eccentrics 26 are pivotally connected to blanking slide connecting rods 20, and innermost crankpin 28 is pivotally connected to forming slide connecting rod 22. Crankpin 28 is angularly offset with respect to eccentrics 26 so that connecting rods 20 and blanking slide 21 will lead connecting rod 22 and forming slide 24 as crankshaft 18 turns. Furthermore, crankpin 28 is such that the total rectilinear travel of connecting rod 22 and forming slide 24 is greater than the total rectilinear travel of blanking connecting rods 20 and slide 21. The relative movements of blanking slide 21 and forming slide 24 are illustrated in FIG. 6. The design of crankshaft 18 to accomplish this relative movement is within normal engineering expertise.

The shell type bearing sleeves 30 are preferably pressure lubricated through passages 32 connected to a lubricant supply (not shown).

Strip stock is fed into press 10 by feed 36, and the scrap is cut off by means of scrap cutter 38. A liftout mechanism 40 is driven by means of chain, belt, or other power transmission 42, which is connected to sprocket 44 and to sprocket 43, the latter driven by crankshaft 18.

Figure 2:
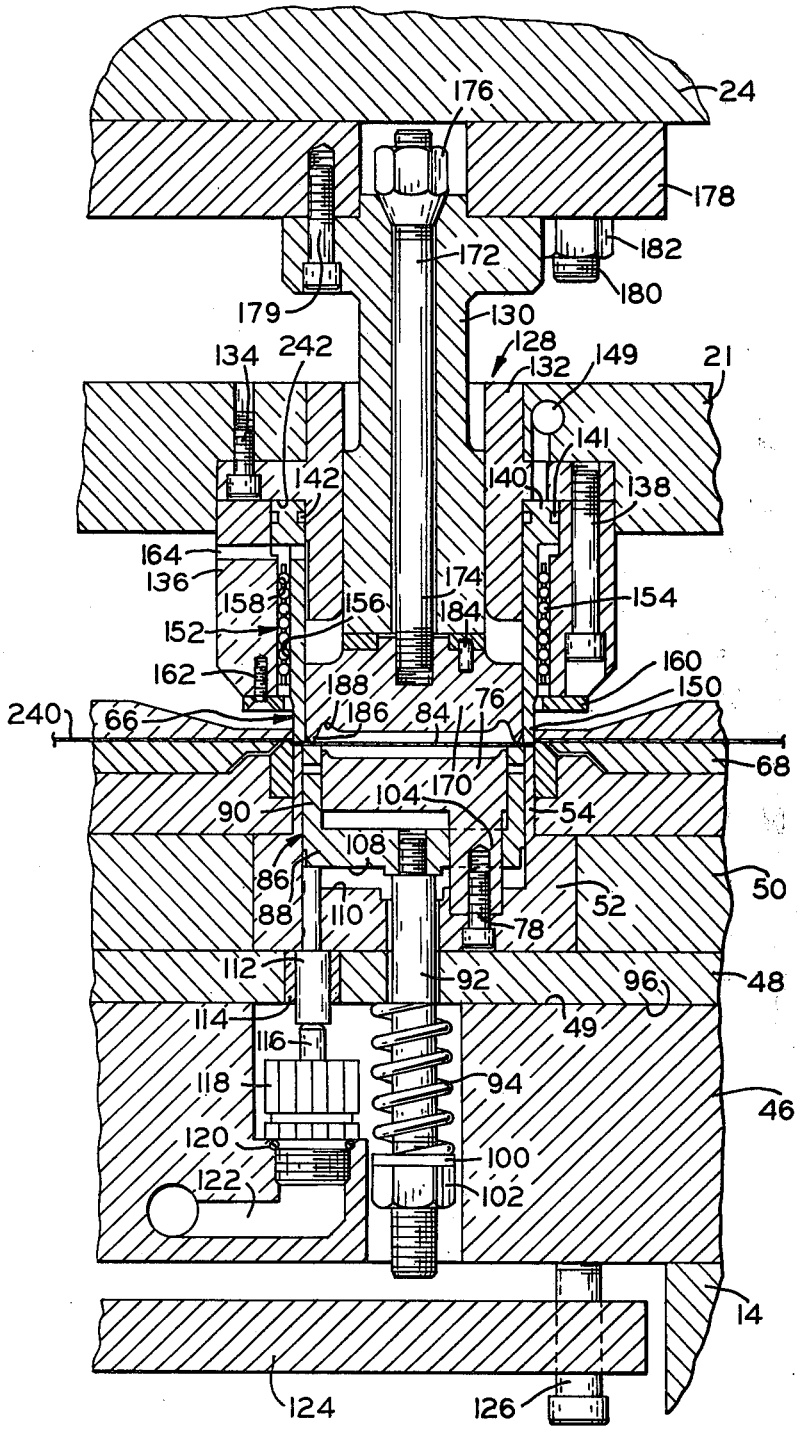
FIG. 2 is an enlarged, fragmentary, sectional view of the press illustrating the blanking and forming punch assembly wherein the blanking slide has moved to the 140° position of its cycle.
Figure 3:
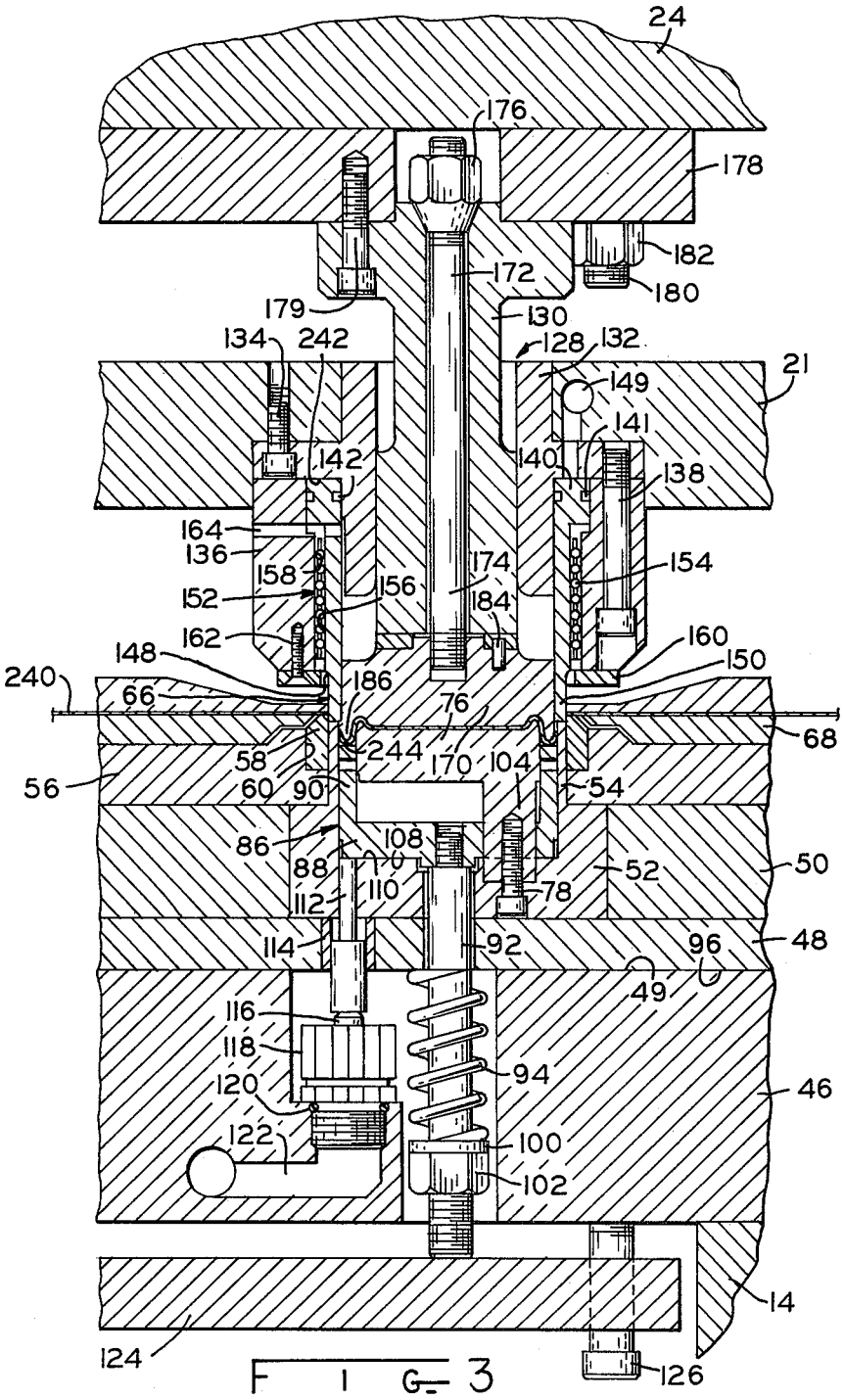
FIG. 3 is a view similar to FIG. 2 wherein the blanking slide is at bottom dead center or 180° of its cycle.
Figure 4:
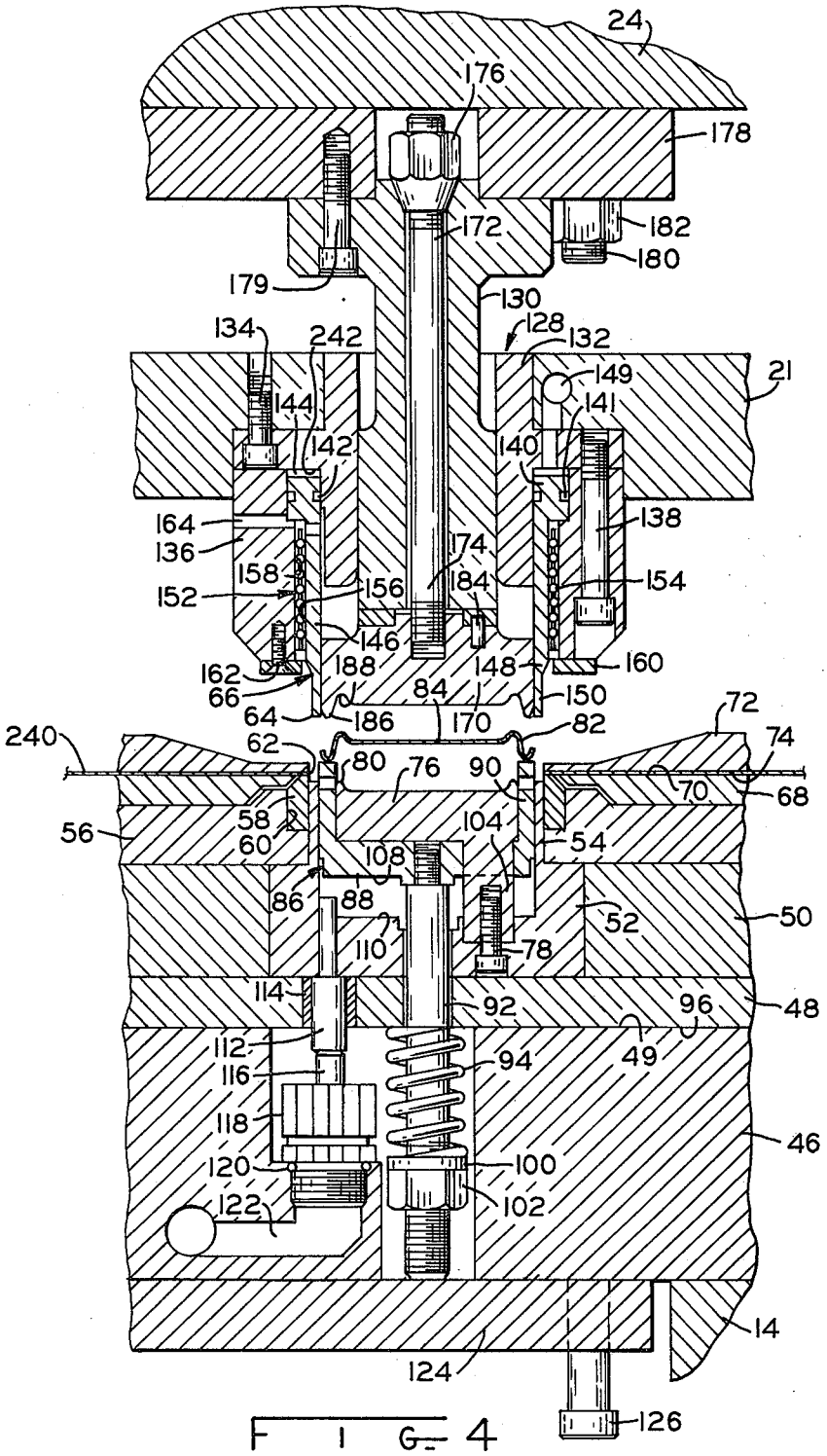
FIG. 4 is a view similar to FIGS. 2 and 3 wherein the blanking side is at 254° of its cycle.

Referring now to FIGS. 2, 3 and 4, the details of the punch assembly will be described. Bolster 46 is secured to bed 14 and lower liftout pin retainer plate 48 is supported on the upper surface 49 thereof. Draw ring retainer 50 is supported on liftout pin retainer 48, and serves to retain draw ring 52 in position. It will be noted that draw ring 52 includes an annular upstanding portion 54 around which cutting die retainer 56 is positioned. Cutting die retainer 56 is secured to draw ring retainer 50, and includes an annular step 60 within which annular cutting die 58 is received. Cutting die 58 includes a cutting edge 62, which cooperates with the edge 64 of punch 66 to stamp out a circular blank when punch 66 is driven downwardly past cutting edge 62, as will be described below. Filler plate 68 overlies and is secured to die retainer plate 56, and the upper surface 70 thereof supports the strip stock 240 as it is advanced through the press in a horizontal direction. Cover plate 72 is rigidly secured in position, and the lower surface 74 thereof is spaced from the upper surface 70 of filler plate 68 so as to provide a substantially planar channel through which the stock material is fed. The space between surfaces 70 and 74 generally defines what is known in the industry as the tin line, a horizontal or inclined plane through which the strip stock is fed by feed mechanism 36 (FIG. 1).

Lower forming die 76, the cross section of which is circular in a plane parallel to the tin line, is connected to draw ring 52 by screws 78. Thus, draw ring retainer 50, draw ring 52, lower forming die 76, pin retainer plate 48 and bolster 46 are rigidly connected to the press frame. Lower forming die 76 includes an annular bead portion 80, which forms a correspondingly shaped bead 82 in the finished can end 84 illustrated in FIG. 4.

Liftout element 86, which includes a generally circular base 88 and an upstanding annular rim portion 90, is slidably received within draw ring 52 for reciprocating movement in the same direction as the direction of movement of slides 21 and 24. Liftout member 88 is yieldably pulled downwardly by means of liftout stem 92, which is threadedly secured to the base portion 88, and compression spring 94, which is disposed between the lower surface 96 of pin retainer plate 48 and a washer 100 held in place by nut 102. The holding force developed by spring 94 can be adjusted by means of nut 102. Liftout member 86 slides around the lower portion 104 of lower forming die 76, and when retracted, its lower surface 108 is in abutment with the upper surface 110 of draw ring 52.

Liftout member 86 is pushed to its intermediate position by means of liftout pins 112, which are slidably received in bushings 114 retained within pin retainer plate 48. Liftout pins 112 are pressed upwardly by stems 116, which are connected to pistons (not shown) within pressure cylinders 118, the latter being threadedly secured to bolster 46 and sealed thereagainst by O-rings 120. A fluid passage 122 is connected to a source of pressurized air to yieldably lift the blanked part against the action of upper die 170. It will be noted that the upper end of pin 112 engages the lower surface 108 of liftout member 86 so as to raise liftout member 86 against the action of spring 94. Stem 92 is lifted by plate 124, which slides over screws 126 connected to bolster 46. FIG. 3 illustrates plate 124 in its fully retracted position.

Turning now to the upper portion of the die set, a housing assembly 128 is slidably disposed with resepct to spindle 130, and retains punch 66 for slidable movement relative thereto. Housing assembly 128 comprises a spindle alignment bearing 132 connected to slide 21 by screws 134, and a guide bushing 136 connected to spindle alignment bearing by screws 138. The upper portion of punch 66 is formed as an annular piston 140 including seals 141 and 142, and reciprocates within an annular cylinder 144 defined by spindle alignment bearing 132 and an annular step in guide bushing 136. The intermediate portion 146 of punch 66 is annular and cylindrical in shape, and punch 66 includes a tapered transition portion 148 between intermediate portion 146 and the lower cutting portion 150 including cutting edge 64. Air pressure from passage 149 yieldably and continuously urges punch 66 downwardly to the position of FIG. 4.

Punch 66 is very accurately guided and aligned within guide bushing 136 by means of cylindrical ball bearing assembly 152, which comprises a cylindrical retainer having a plurality of ball bearings 154 captured therein. A portion of the ball bearings 154 are in rolling engagement with the outer cylindrical surface 156 of the intermediate portion 146 of punch 66, and the remainder of the ball bearings 154 are in rolling engagement with the inner concave cylindrical surface 158 of guide bushing 136. Bearing assembly 152 is held in place by bearing retainer 160, which is secured to guide bushing 136 by screws 162. Bearing assembly 152 is preferably preloaded so that very precise tolerances can be maintained with respect to the position of the punch 66 relative to cutting edge 62. As discussed above, this is important from the standpoint of always ensuring optimum clearance, which reduces wear on the cutting edges 62 and 64. Passage 164 provides venting for cylinder 144 when punch 66 is extended to the position shown in FIG. 4.

Upper forming die 170 is rigidly connected to spindle 130 by retaining rod 172, which is threadedly secured at its lower end 174 to forming die 170, and is held against spindle 130 at its upper end by nut 176. Spindle 130 is connected to top plate 178 by screws 179, and plate 178 is connected to slide 24 by bolts 180 and nuts 182. Dowel 184 prevents rotation between forming die 170 and spindle 130. It will be noted that forming die 170 comprises an annular bead portion 186 around its periphery and an annular groove 188 adjacent bead 186.

Figure 5:
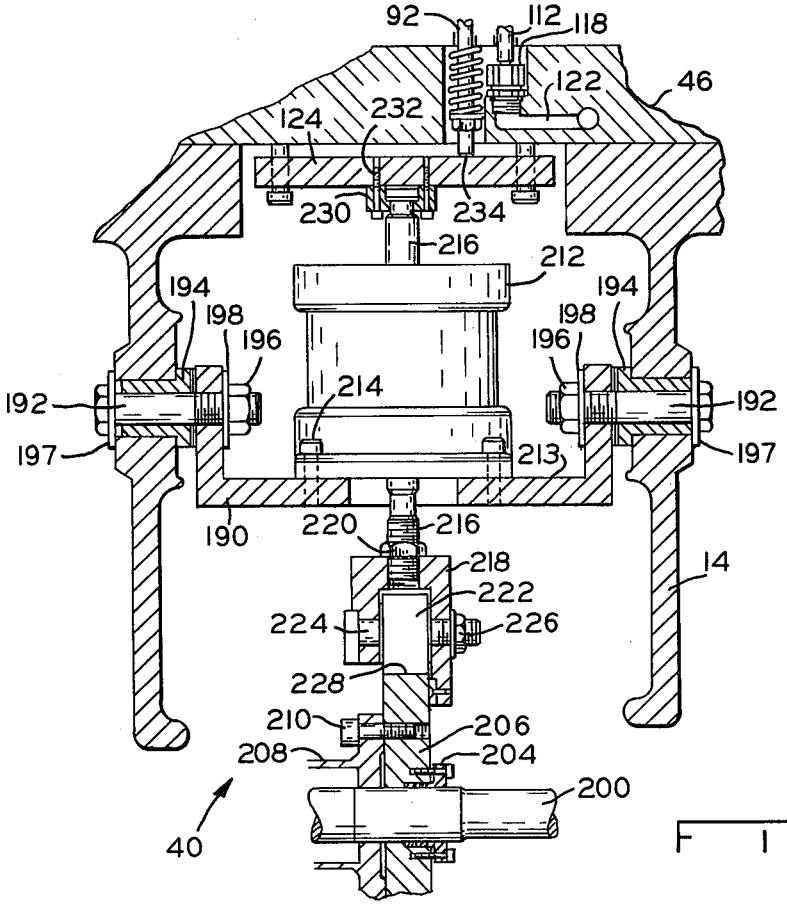
FIG. 5 is an enlarged, sectional view of the liftout mechanism.

With reference to FIG. 5, the liftout mechanism 40 comprises a bracket 190 secured to the bed 14 of press 10 by bolts 192, which are received within sleeves 194 and held in place by nuts 196. Washers 197 and 198 are positioned between bolts 192 and bed 14, and between nuts 196 and bracket 190, respectively. A cam shaft 200 is rotatably supported by bearings 202 connected to legs 16 (FIG. 1), and terminates in sprocket 44, which is in engagement with chain 42. Since chain 42 is driven by sprocket 43, which is connected to crankshaft 18, the rotation of cam shaft 200 will be synchronized with that of crankshaft 18 so that liftout occurs at the proper time in the press cycle. Cam 206 is connected to shaft 200 by an interference fit sleeve 204, which is screwed to cam 206. Sleeve 208 is connected to cam 206 by screws 210.

Cushion cylinder 212 is connected to the upper surface 213 of bracket 190 by screws 214, and includes a double ended cushion stem 216 connected to a piston (not shown) within cylinder 212. Cylinder 212, which is supplied with pressurized air from a suitable source of supply, exerts constant downward pressure on stem 216. The lower end of stem 216 is threadedly secured to follower yoke 218, and locked thereagainst by lock nut 220. Cam follower 222 is rotatably supported on shaft 224, the latter extending through yoke 218 and secured thereto by nut 226. As cam 206 is rotated, cam follower 222 will roll on its peripheral surface 228 and cause stem 216 to be lifted and lowered at the appropriate times in the press cycle.

The upper end of stem 216 is connected to plate 124 by stem retainer 230, which is connected to plate 124 by screws 232. The lower end 234 of stem 92 is contacted by the upper surface of plate 124 when stem 216, yoke 218 and follower 222 are pushed upwardly by cam 206.

With reference now to FIGS. 2, 3, 4 and 6, the operation of press 10 will be described. The steel or aluminum strip material 240 is advanced by feed mechanism 36 so that an unblanked portion is positioned within the die set. Meanwhile, blanking slide 21 and forming slide 24 are moving downwardly under the action of crankshaft 18, with blanking slide 21 leading forming slide 24 slightly as shown in FIG. 6. It will also be appreciated that the total travel of forming slide 24 is greater than the total travel of blanking slide 21, a situation which is necessitated by the greater travel required for the drawing operation.

As blanking slide 21 moves downwardly, the lower edge of punch 66 will contact and reset on the upper surface of strip material 240, but no cutting of the strip material will occur at this time because blanking slides 21 and guide bushing 136 have not yet caught up to punch 66. At approximately 140° of the press cycle, the surface 242 of guide bushing 132 will contact the upper surface of the piston portion 140 of punch 66 and drive cutting edge 64 downwardly past the cutting edge 62 of cutting die 58 so as to blank out a circular disk 84 from the strip material 240. The press in this position is illustrated in FIG. 2 wherein the punch 66 has just cut through the strip material 240.

Punch 66 continues to travel past cutting edge 62 by a slight amount to the bottom dead center position illustrated in FIG. 3. At the same time, forming slide 24 will cause the upper forming die 170 to passs by the lower edge of punch 66 and draw the blank 84 to the shape illustrated in FIG. 3. In forming this shape, bead 186 presses liftout member 90 downwardly against the action of liftout pins 112 and forms a bead 244 into the blank 84 as it passes into the annular space between draw ring 54 and lower forming die 76. At the same time, groove 188 cooperates with bead 80 to form bead 82.

While the drawing operation is occurring, blanking slide 21 begins to move upwardly as shown in FIG. 6, but the air pressure within cylinder 144 holds the lower edge of punch 66 against blank 84 during at least a portion of the drawing operation. Forming slide 24 then also begins to move upwardly at about the same time that guide bushing 136 begins to lift punch 66, which is just a few degrees past bottom dead center. Forming die 170 and punch 66 move upwardly together, and at the same time cam 206 begins to lift follower 222, yoke 218, stem 216, plate 124 and stem 92, which lifts liftout member 86 and strips the part 84 from lower die 76 to the position shown in FIG. 4. During stripping of part 84, both punch 66 and upper forming die 170 are maintained in close contact with part 84 so that maximum control is realized. When part 84 has been lifted to the position shown in FIG. 4, it is ejected by a mechanical kicker, or by a blast of air, or by gravity, as in the case of an inclined press, or by a combination of any two or all three of these means.

As cam 206 continues to rotate, spring 94 will cause liftout member 86 to be retracted below the tin line, and another segment of strip material 240 is fed into the die. The press then recycles to again perform the operations described above.

Although springs and pressurized air have been used for various biasing functions in the press described above, in some cases they are interchangeable. For example, spring pressure could be utilized to bias punch 66 downwardly rather than pressurized air as in the preferred embodiment. The ball bearing assembly 152 utilized to guide punch 66 can be any one of a variety of commercially available bearings, such as those manufactured by Lempco Industries Inc.

Although an open back inclinable, double action press 10 has been described in connection with the invention, the invention is not so limited to this type of press. Furthermore, the invention could be utilized for manufacturing parts other than can ends, and the particular blanking and forming operations described above are merely exemplary and are not intended to limit the invention in its broadest form. The invention also encompasses presses having a plurality of punches in the die set.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A blanking and forming punch assembly for a double action press having two slides reciprocated through separate strokes, said punch assembly comprising:

a guide housing connected to one of the press slides, a blanking punch received in said guide housing for reciprocating movement relative to said housing along a given rectilinear direction, a preloaded antifriction bearing positioned between said punch and housing and in continuous antifriction contact with said punch and housing during the entire stroke of said punch to accurately guide and align said punch relative to said housing, means interposed between said punch and housing for yieldably urging said punch in a direction out of said housing toward one of the limits of travel of said punch relative to said housing, a forming die received in said guide housing for reciprocating movement relative to said housing along said rectilinear direction, said forming die being connected to the other press slide, and a die assembly mounted to the press and coacting with said punch and forming die.

2. The punch assembly of claim 1 wherein said punch is annular and concentric with said forming die.

3. The punch assembly of claim 2 wherein said punch includes an annular piston portion slidably received in a cylinder, and said means for yieldably urging comprises a fluid passageway in communication with said cylinder and adapted for connection to a source of pressurized fluid.

4. The punch assembly of claim 2 wherein said bearing comprises an annular retainer having a plurality of ball bearings retained herein.

5. A double action press comprising:

a bed portion, a blanking slide, a forming slide drive means connected to said slides for reciprocating said slides along respective rectilinear paths on one side of said bed portion, said drive means comprising a crankshaft having at least two eccentrics thereon and at least two connecting rods connected to respective said slides and respective said eccentrics, said drive means causing said blanking slide to lead said forming slide, a forming die comprising a first forming tool element connected to said forming slide and a second forming tool element connected to the bed portion of the press, said tool elements adapted to coact with each other to form a part therebetween when brought together by said forming slide, a blanking die comprising a blanking punch connected to said blanking slide and a blanking tool element connected to the bed portion of the press, said punch and blanking tool element adapted to coact with each other to cut out a blank when brought together by said blanking slide at about the dead center position of the eccentric driving said blanking slide, said punch being reciprocally connected to said blanking slide for movement relative to said blanking slide in a direction parallel to the rectilinear movement of said blanking slide, said drive means causing said blanking slide to positively and non-yieldably engage said punch at about said dead center position of the eccentric driving said blanking slide to cut out a blank, and means for yieldably urging said punch in said rectilinear direction of said blanking slide away from said blanking slide to extend relative to said blanking slide and exert a holding force on the blank as said blanking slide moves away.

6. The press of claim 5 wherein the total rectilinear travel of said blanking slide is greater than the total rectilinear travel of said forming slide.

7. The press of claim 6 wherein the press defines a generally planar feed path for strip stock between said first and second forming elements and between said punch and blanking tool element, and said first forming tool element travels through and past the plane of the feed path to a greater extent than does said punch.

8. The press of claim 6 wherein the eccentric pertaining to said blanking slide is angularly offset relative to the eccentric pertaining to said forming slide to cause said blanking slide to lead said forming slide in both directions of the reciprocating movement thereof.

9. The press of claim 5 wherein said blanking punch is slidably connected to said blanking slide, and said blanking tool element includes a cutting edge cooperating with the said punch to cut out a blank from stock fed into the press.

10. The press of claim 9 wherein said cutting edge and punch encircle said forming die, and said drive means causes said punch and cutting edge to come together before said forming tool elements come together.

11. The press of claim 6 wherein said means for yieldably urging causes said punch to exert a holding force on a blanked out part during at least a portion of the forming operation performed by said forming die.

12. The press of claim 5 wherein said means for yieldably urging comprises a resilient medium interposed between said punch and blanking slide.

13. The press of claim 12 wherein said means for yieldably urging comprises a piston and cylinder connected between said punch and blanking slide, and said resilient medium is a pressurized fluid in said cylinder.

14. The press of claim 12 wherein a portion of said punch is formed as a piston which reciprocates within a cylinder in said blanking slide, and said medium is a pressurized fluid admitted into said cylinder.

15. The press of claim 5 wherein said means for yieldably urging comprises a piston and cylinder connected between said punch and blanking slide, and means for admitting pressurized fluid into said cylinder.

16. The press of claim 5 including a preloaded, antifriction bearing means interposed between said punch and said blanking slide for accurately guiding and aligning said punch relative to said blanking slide.

17. The press of claim 5 wherein the total rectilinear travel of said punch is less than the total rectilinear travel of said blanking slide for each cycle of the press due to the reciprocal connection between said punch and blanking slide.

* * * * *

UNITED STATES PATENT AND TRADEMARK OFFICE

CERTIFICATE OF CORRECTION

PATENT NO. : 4,442,691

DATED : April 17, 1984

INVENTOR(S) : Arthur L. Grow, et al

It is certified that error appears in the above—identified patent and that said Letters Patent is hereby corrected as shown below:

Col. 3, line 47, change "side" to --slide--.

Col. 6, line 47, change "reset" to --rest--.

Col. 6, line 62, change "passs" to --pass--.

Col. 8, claim 4, line 22, change "herein" to --therein--.

Signed and Sealed this

*Eleventh* Day of *September 1984*

[SEAL]

*Attest:*

GERALD J. MOSSINGHOFF

*Attesting Officer*

*Commissioner of Patents and Trademarks*